US006877489B2

(12) United States Patent
Hashimoto et al.

(10) Patent No.: US 6,877,489 B2
(45) Date of Patent: Apr. 12, 2005

(54) ELECTRONICALLY CONTROLLED FUEL INJECTION DEVICE

(75) Inventors: Shogo Hashimoto, Kanagawa (JP); Ryoji Ehara, Kanagawa (JP); Hiroshi Mizui, Kanagawa (JP); Tadashi Nichogi, Kanagawa (JP); Junichiro Takahashi, Kanagawa (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/438,010

(22) Filed: May 15, 2003

(65) Prior Publication Data

US 2004/0020475 A1 Feb. 5, 2004

Related U.S. Application Data

(63) Continuation of application No. PCT/JP01/09771, filed on Nov. 8, 2001.

(30) Foreign Application Priority Data

Nov. 17, 2000 (JP) ..... 2000-351504

(51) Int. Cl.[7] ..... F02M 33/02
(52) U.S. Cl. ..... 123/520; 123/514
(58) Field of Search ..... 123/520, 514, 123/516, 518, 490, 499, 506; 60/283, 285

(56) References Cited

U.S. PATENT DOCUMENTS 5,469,828 A * 11/1995 Heimberg et al. ..... 123/497
5,520,154 A * 5/1996 Heimberg et al. ..... 123/499
5,540,206 A * 7/1996 Heimberg ..... 123/497
5,608,369 A * 3/1997 Irgens et al. ..... 335/281
5,890,662 A * 4/1999 Dykstra ..... 239/585.1
6,276,340 B1 * 8/2001 Kato ..... 123/491

FOREIGN PATENT DOCUMENTS

| | | |
|---|---|---|
| CA | 2218695 | 10/1996 |
| EP | 0 756 292 | 1/1997 |
| EP | 0 756 293 | 1/1997 |
| EP | 0 992 676 | 4/2000 |
| JP | 61-175565 | 11/1986 |
| JP | 1-83166 | 6/1989 |
| JP | 3-121254 | 5/1991 |

OTHER PUBLICATIONS

Patent Abstracts of Japan, vol. 015, No. 321 (M–1147), Aug. 15, 1991 & JP 03 121254 A (Electron Control Syst. Co., Ltd.) May 23, 1991.

* cited by examiner

*Primary Examiner*—Mahmoud Gimie
(74) *Attorney, Agent, or Firm*—Wenderoth, Lind & Ponack, L.L.P.

(57) ABSTRACT

An electronically controlled fuel injection device includes a plunger pump constituted by a cylinder, a plunger is slidably mounted within the cylinder to form a pressure chamber, and a solenoid coil for driving the plunger. At a lower section of a body that encases the plunger pump, an intake section is coupled to the pressure chamber to cause intake of fuel into the pressure chamber upon operation of the plunger. At an upper section of the body, a return section is arranged to return surplus fuel to a fuel tank. A circulation passage branches off from the intake section and is provided between the cylinder and the solenoid coil for guiding a portion of the fuel toward the return section. With this arrangement, penetration of vapor into the fuel injection device is suppressed, and an inexpensive and highly durable electronically controlled fuel injection device is provided.

38 Claims, 2 Drawing Sheets

ELECTRONICALLY CONTROLLED FUEL INJECTION DEVICE

This application is a continuation application of International application PCT/JP01/09771, filed Nov. 8, 2001.

BACKGROUND OF THE INVENTION

1. Field of the Invention

The present invention relates to a fuel injection device, and more particularly to an electronically controlled fuel injection device employed by an internal combustion engine mounted on a two-wheeled vehicle or other vehicle.

2. Description of the Related Art

Conventionally, in an internal combustion engine mounted on a two-wheeled vehicle or other vehicle, for example, a so-called fuel injection device is employed, which, while pressurizing fuel by means of a fuel injection pump, feeds the fuel to a fuel injection nozzle and supplies the fuel to an intake path following atomization in the fuel injection nozzle.

Also, in order to feed fuel to the fuel injection device, the fuel injection device and the fuel tank where the fuel is retained are coupled by means of a fuel supply pipe.

In this connection, in a conventional fuel injection device of this kind, when the temperature of the fuel rises as a result of a rise in the ambient temperature, for example, vapor is produced within the fuel.

Further, when the vapor amount exceeds the discharge capacity of the fuel injection pump, there are problems such as control of the fuel supply amount being adversely affected.

In order to improve such problems, in the prior art, a fuel pump that supplies fuel is disposed upstream of the fuel injection pump, and fuel is continuously pressurized at or above a prescribed pressure by means of this fuel pump.

This handling method involves liquefaction of the vapor by pressurizing the fuel at or above a prescribed pressure, such that the liquefied vapor is contained within the fuel.

However, with a vapor elimination method using fuel pressurization of this kind, the following problems remain unsolved.

That is, in the handling method described above, in order that fuel within the fuel supply path arriving at the fuel injection pump should be continuously held at or above a prescribed pressure, as described hereinbelow, a fuel pump other than a fuel injection pump is necessary. The high pressure created by this fuel pump makes it necessary for the fuel supply path to be formed using a high-pressure pipe or a high-pressure hose, or the like. The use of such high-pressure pipe or high-pressure hose disadvantageously causes the manufacturing costs to rise sharply.

Further, since the fuel must be kept in a pressurized condition even when the internal combustion engine has been stopped, the burden on the device is considerable, and this is undesirable also in terms of durability.

SUMMARY OF THE INVENTION

In view of such conventional problems, it is an object of the present invention to suppress the penetration of vapor into the fuel injection device, and to provide an electronically controlled fuel injection device that is inexpensive and highly durable.

In order to attain the above-described objects, the electronically controlled fuel injection device of the present invention is provided below a fuel tank where fuel is retained by pressurizing the fuel following intake of the fuel from the fuel tank, injects this fuel into an intake passage of an internal combustion engine. This fuel injection device comprises: a body; a plunger pump mounted within the body for drawing in and pressure-feeding the fuel; and an injection nozzle mounted in the body for injecting the fuel. The plunger pump is constituted by a cylinder, a plunger slidably mounted within the cylinder to form a pressure chamber, and a solenoid coil for driving the plunger. At a lower section of the body, an intake section is coupled to the pressure chamber to cause intake of fuel into the pressure chamber upon operation of the plunger. At an upper section of the body, a return section is provided for returning surplus fuel to the fuel tank. A circulation passage is provided between the cylinder and the solenoid coil and branches off from the intake section for guiding a portion of the fuel toward the return section.

The electronically controlled fuel injection device of the present invention further includes an exhaust passage formed at the center of the plunger for guiding the surplus fuel to the return section. A preliminary pressure valve is provided within this exhaust passage for imparting a preliminary pressure to the fuel at an initial stage of a pressurizing stroke of the plunger.

The electronically controlled fuel injection device of the present invention further includes a spill valve provided within the pressure chamber for initiating a pressurizing operation of the fuel by blocking the exhaust passage as a result of being contacted by the plunger upon completion of a preliminary pressure operation by the plunger.

The electronically controlled fuel injection device further includes a check valve which allows the fuel to flow into the plunger pump only during an intake stroke of the plunger pump. This check valve is provided downstream of a branch section of the intake section that guides fuel to the circulation passage, so as to bypass the check valve.

The electronically controlled fuel injection device of the present invention further includes a fuel return pipe connected between the fuel tank and the exhaust section of the electronically controlled fuel injection device. An end of this fuel return pipe opens into a vacant section of the fuel tank.

DETAILED DESCRIPTION OF THE INVENTION

A description of a first embodiment of the present invention is provided hereinbelow with reference to the figures.

Figure 1:
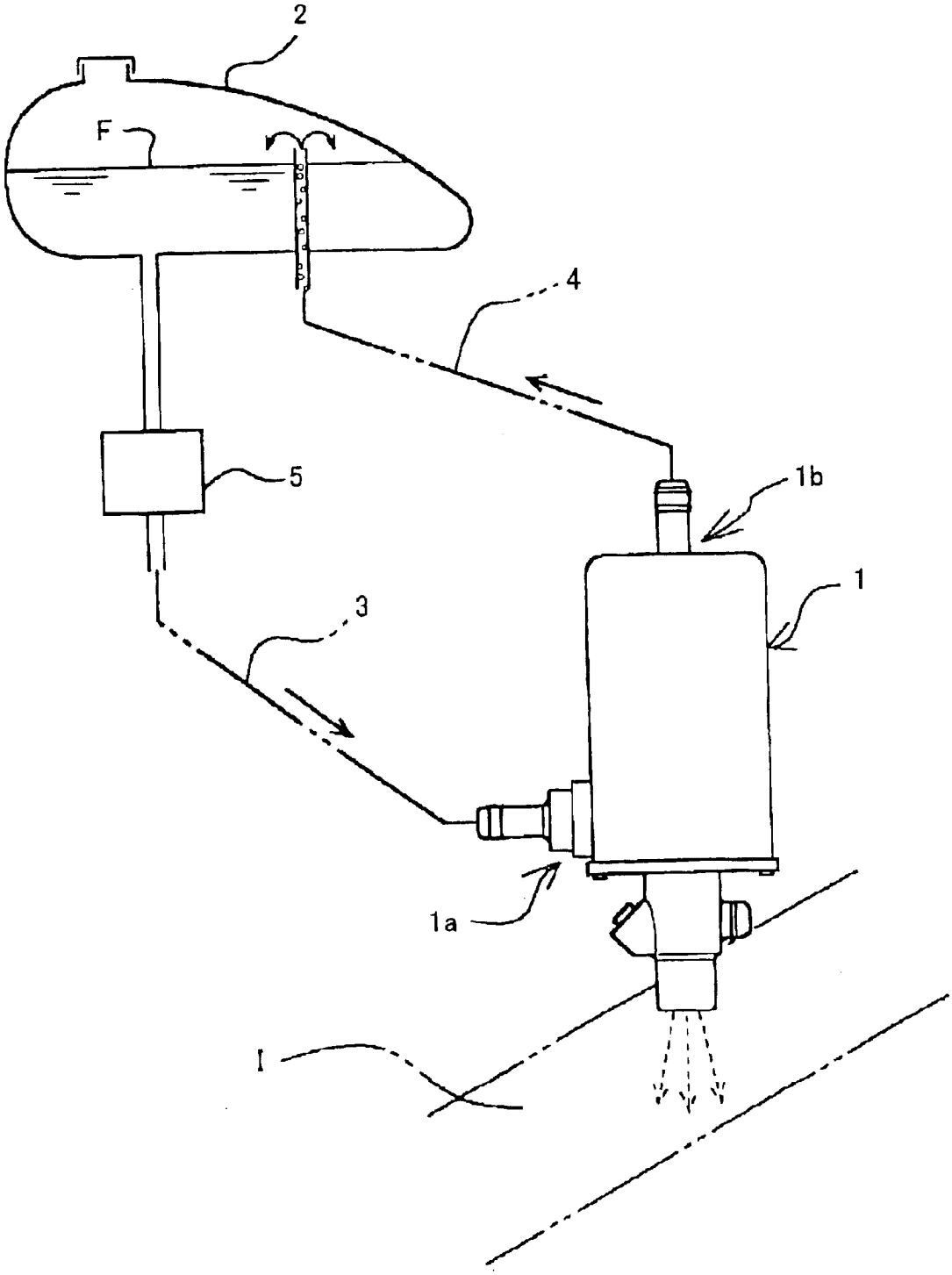
FIG. 1 is a system configuration view of the fuel supply system to which the electronically controlled fuel injection device relating to a first embodiment of the present invention is applied.

FIG. 1 is a configuration view of a fuel supply system to which an electronically controlled fuel injection device 1 relating to the present embodiment is applied.

In this fuel supply system, the electronically controlled fuel injection device 1 is provided below a fuel tank 2 where fuel F is retained. The electronically controlled fuel injection device 1 pressurizes the fuel F following intake of the fuel F from the fuel tank 2, to thereby inject the fuel F into an intake passage I of an internal combustion engine. The electronically controlled fuel injection device 1 includes an intake section 1*a* in its lower section. The intake section 1*a* is fluidically coupled to the fuel tank 2 by a feed pipe 3 that supplies the fuel F. A return section 1*b* is provided in an upper section of the electronically controlled fuel injection device 1, and the return section 1*b* is coupled to the fuel tank 2 by a return pipe 4 that returns surplus fuel evacuated from the electronically controlled fuel injection device 1 to the fuel tank 2. A low pressure filter 5 is provided midway along the feed pipe 3.

Figure 2:
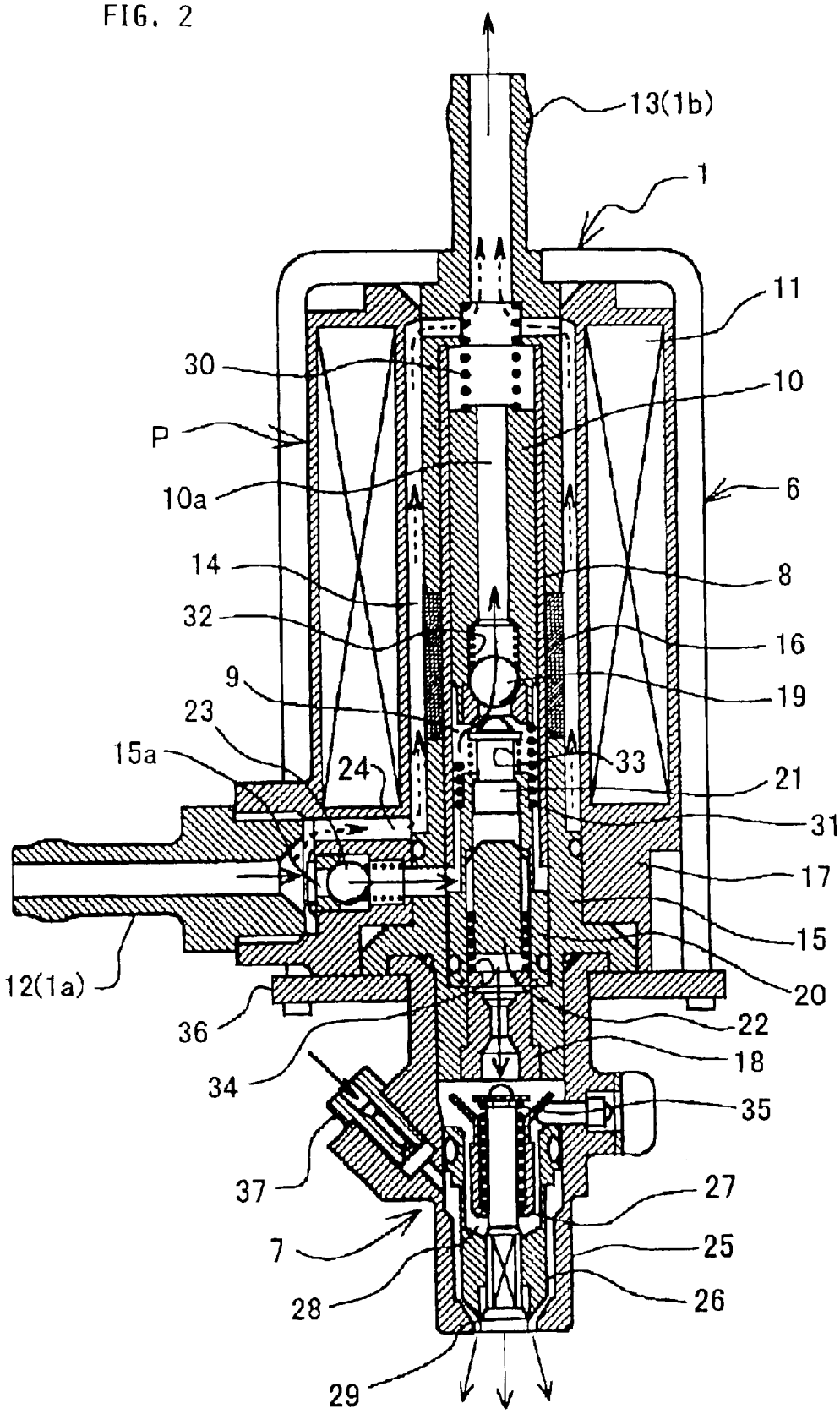
FIG. 2 is an enlarged vertical cross-sectional view of principal parts of the first embodiment of the present invention.

As shown in FIG. 2, the electronically controlled fuel injection device 1 comprises: a body 6; a plunger pump P, which is mounted within the body 6, and which draws in and pressure-feeds the fuel F; and an injection nozzle 7, which is mounted in the body 6, and which injects the fuel. The plunger pump P is constituted by a cylinder 8, a plunger 10, which is slidably mounted within the cylinder 8 to form a pressure chamber 9, and a solenoid coil 11, which drives the plunger 10. In the lower section of the body 6, an intake contact pipe 12 of the intake section 1*a* is provided and, in the upper section of the body 6, a return contact pipe 13 of the return section 1*b* is provided. A circulation passage 14 is provided between the cylinder 8 and solenoid coil 11 and branches off at the intake section 1*a* toward the return section 1*b* for guiding a portion of the fuel to the return section.

Next, describing this in detail, the return contact pipe 13 is fitted over the cylinder 8 so as to cover the outer circumference of the upper section of the cylinder 8, an outer cylinder 15 is fitted over the lower section of the cylinder 8, and an intermediate pipe 16 is mounted between the outer cylinder 15 and the return contact pipe 13.

Then, an annular core 17 is fitted so as to cover the return contact pipe 13, the intermediate pipe 16, and the outer cylinder 15. The core 17 has a solenoid coil 11 wound thereon, and the circulation passage 14 is formed between the inner surface of the core 17, and respective outer circumferential faces of the return contact pipe 13, the intermediate pipe 16, and the outer cylinder 15.

Also, the lower section of the outer cylinder 15 protrudes from below the body 6, and a measurement orifice 18, fluidically coupled to the pressure chamber 9, is provided in the protruding end of the lower section of the outer cylinder 15.

An exhaust passage 10*a*, which guides the surplus fuel to the return section 1*b*, is formed at the center of the plunger 10, and a preliminary pressure valve 19, which imparts a preliminary pressure to the fuel F at an initial stage of a pressurizing stroke of the plunger 10, is provided within this exhaust passage 10*a*.

A sub-cylinder 20 is mounted in the outer cylinder 15 at an upper end of the measurement orifice 18 so as to be spaced apart from the lower end of the plunger 10, such that the pressure chamber 9 is formed between the outer circumferential face of the sub-cylinder 20, the inner circumferential face of the outer cylinder 15, and the inner circumferential face of the cylinder 8.

Further, a spill valve 21 is provided in the upper section of the sub-cylinder 20 to initiate a pressurizing operation of the fuel by blocking the exhaust passage 10*a* as a result of being contacted by the plunger 10 at a time when a preliminary pressure operation by the plunger 10 has been completed. Further, an outlet check valve 22 is provided in the lower section of the sub-cylinder 20, and is opened at a time when the pressure of the fuel F inside the pressure chamber 9 has reached a prescribed pressure.

In addition, at the lower end of the annular core 17, in a position where the intake contact pipe 12 is mounted, an intake passage 15*a* is formed that fluidically couples the intake contact pipe 12 with the pressure chamber 9. Midway along this intake passage 15*a*, an inlet check valve 23 is provided as a check valve which allows the fuel F to flow into the pressure chamber 9 only during an intake stroke of the plunger 10.

Also, a linked branch passage 24 is formed adjacent the intake passage 15*a* and branching from the passage of the intake contact pipe 12 at a position upstream of the inlet check valve 23 to fluidically couple the intake contact pipe 12 with the circulation passage 14. Thus, a portion of the fuel F is continuously guided through the intake contact pipe 12 to the circulation passage 14.

Meanwhile, the injection nozzle 7 is constituted by a nozzle body 25, which is fitted over the outer circumference of the lower end of the outer cylinder 15; a cylindrical guide member 26 disposed within the nozzle body 25 and including a fuel injection passage 28; a cylindrical holding member 27 mounted so as to be capable of reciprocating movement inside the guide member 26; and a poppet valve 29 movably mounted in the holding member for reciprocating movement relative to the holding member 27 and so as to open and close the fuel injection passage 28 of the guide member 26.

Further, centering springs 30, 31 are provided for urging the plunger 10 to a neutral position, and return springs 32, 33, 34, 35 and 36 are provided for forcing a preliminary pressure valve 19, a spill valve 21, an outlet check valve 22, a poppet valve 29 and the inlet check valve 23, respectively, into closed positions.

Further, when the injection nozzle 7 is opened (i.e., when the fuel injection passage 28 is opened by the movement of the poppet valve 29 to an open position), an assist air orifice 37 supplies air to the injection nozzle 7 due to the negative pressure within the air passage 1, and causes atomization of the fuel as the fuel is injected from the injection nozzle 7.

In addition, in the present embodiment, the end of the return pipe 4 coupled to the fuel tank 2, opens into a vacant section of the fuel tank 2, as shown in FIG. 1.

Next, a description will be provided of the operation of the electronically controlled fuel injection device 1 of the present embodiment.

The plunger pump P is operated in accordance with the operation of the internal combustion engine, the plunger 10 is displaced in a reciprocating fashion, and the fuel F from the fuel tank 2 is pressurized following intake of the fuel F into the plunger pump P via the feed pipe 3, and is injected via the injection nozzle 7 into the intake passage I in an atomized form.

In other words, intake of the fuel F is such that, when the plunger 10 is caused to return to a neutral position, the pressure chamber 9 is afforded a negative pressure, and therefore, as a result of the inlet check valve 23 being opened, the fuel F is drawn into the pressure chamber 9 via the intake passage 15*a*.

Therefore, during driving of the plunger 10 by the solenoid coil 11, when the plunger 10 is caused to move down against the resistance of the centering spring 31, pressurization of the fuel F inside the pressure chamber 9 is initiated.

Further, in an initial stage of such a pressurizing stroke, the inlet check valve 23 is closed, such that the fuel F inside the pressure chamber 9 is pressurized. When the pressure of the fuel F has resin to a prescribed pressure, the preliminary pressure valve 19 is opened against the bias of the return spring 32 and a portion of the fuel inside the pressure chamber 9 is evacuated through the exhaust passage 10*a* of the plunger 10 to return to the fuel tank 2 via the return contact pipe 13 and the return pipe 4. Consequently, the fuel F in an initial stage of the above-described pressurizing stroke is maintained at a prescribed pressure.

As the descent of the plunger 10 continues, the lower end face of the plunger 10 comes into contact with the spill valve 21 such that the spill valve 21 obstructs flow of the fuel into the exhaust passage 10*a*. As such, the continued descent of the plunger 10 causes further pressurization of the fuel F inside the pressure chamber 9 and, when the pressure in the pressure chamber 9 has risen to a prescribed pressure, the outlet check valve 22 is opened against the bias of the return spring 34, such that the fuel F inside the pressure chamber 9 is fed via the measurement orifice 18 to the injection nozzle 7, whereupon, as a result of the poppet valve 29 being opened, the fuel F is injected via the fuel injection passage 28 to the intake passage I.

Further, during such fuel injection, assist air is supplied from the assist air orifice 37 to cause atomization of the fuel F being injected to the intake passage 1.

Meanwhile, as a result of the above-described intake operation of the fuel F, the downstream side of the low-pressure filter 5 of the feed pipe 3 is afforded a negative pressure, thereby causing vaporization of fuel on the downstream side of the low-pressure filter 5. Also, during the injection of the fuel F, the operation of the plunger pump P generates heat, thereby causing the temperature of the fuel F being drawn thereinto to rise steadily, and, consequently, causing fuel vaporization.

However, in the present embodiment, the intake contact pipe 12 is fluidically coupled via the branch passage 24 to the circulation passage 14 that is formed around the plunger 10, and is thereby fluidically coupled to a vacant upper section of the fuel tank 2 via the return contact pipe 13 and the return pipe 4.

Accordingly, vapor produced upstream of the inlet check valve 23 of the intake passage 15*a*, and vapor produced in the branch passage 24 and the circulation passage 14 as a result of the increased temperature, floats upward through the circulation passage 14, passes through the return contact pipe 13 and the return pipe 4, and is thus discharged to the vacant upper portion of the fuel tank 2. As the fuel vapor floats upward, liquid fuel is carried by the vapor through the circulation passage 14.

Therefore, in the present embodiment, a bubble pump is formed using the vapor, such that surplus fuel F from the fuel tank 2, which has not been drawn in by the plunger pump P, is continuously circulated so as to be returned to the fuel tank 2 after bypassing the pressure chamber 9 of the plunger pump P.

As a result of this circulation of the surplus fuel F, the majority of the vapor generated within the fuel F is discharged to the vacant section of the fuel tank 2, and the amount of vapor drawn into the pressure chamber 9 is therefore markedly suppressed.

Also, by way of example, in the present embodiment, even if vapor is drawn into the pressure chamber 9, the fuel F is afforded a preliminary pressure by the preliminary pressure valve 19 in an initial stage of a pressurizing stroke of the plunger pump P, and, as a result, the mixed vapor is liquified.

Alternatively, as a result of the preliminary pressure valve 19 being opened when the fuel F in the pressure chamber 9 has reached a prescribed pressure, vapor which has not been liquefied by means of a preliminary pressure is fed to the exhaust passage 10*a* of the plunger 10 via the preliminary pressure valve 19, and is then discharged to the fuel tank 2.

Therefore, by means of the electronically controlled fuel injection device 1 of the present embodiment, the penetration of vapor into the plunger pump P is kept as small as possible, and a drop in the discharge capacity of the plunger pump P is suppressed. Accordingly, control accuracy of the fuel injection amount is maintained.

Moreover, since the vapor is discharged to the fuel tank 2 as a result of the natural circulation produced by a bubble pump, continuous pressurization of the fuel F for the purpose of vapor elimination is not required. Consequently, a fuel pump, as required conventionally, becomes unnecessary, and the required pressure resistance for all the pipes that circulate the fuel F is also small.

Further, although the shapes and dimensions of the constituent parts illustrated in the embodiment described above represent one example of the present invention, a variety of modifications are possible depending on design requirements and the like.

As described hereinabove, according to the electronically controlled fuel injection device of the present invention, it is possible to keep the penetration of vapor into the plunger pump as small as possible, to suppress a drop in the discharge capacity of the plunger pump, and to thus maintain control accuracy of the fuel injection amount.

Moreover, since this vapor is discharged to the fuel tank as a result of the natural circulation produced by a bubble pump, continuous pressurization of the fuel for the purpose of vapor elimination is not required. Consequently, a fuel pump, as required conventionally, becomes unnecessary, and the required pressure resistance for all the pipes that circulates the fuel is also small.

What is claimed is:

1. A fuel injection device adapted to inject fuel from a fuel tank into a fuel intake part of an internal combustion engine, said fuel injection device comprising:

a body;

an intake section provided at a lower section of said body and arranged for intake of the fuel from the fuel tank;

a return section provided at an upper section of said body and arranged to return surplus fuel to the fuel tank;

an injection nozzle mounted to said body and arranged to inject the fuel into the fuel intake part of the internal combustion engine; and a plunger pump mounted in said body and comprising a plunger-receiving body having a passage extending therethrough, a plunger disposed in said passage of said plunger-receiving body, and a pressure chamber at least partly formed in said passage of said plunger-receiving body at an end of said plunger and communicated with said intake section, said plunger being movably disposed in said passage for reciprocal movement therein in a first direction to perform an intake stroke to draw the fuel into said pressure chamber and in a second direction to perform a pressurizing stroke to pressurize the fuel in said pressure chamber;

wherein said plunger pump further includes a plunger-driving motor operably coupled to said plunger to drive said plunger in at least one of said first and second directions;

wherein a circulation passage is provided between said plunger-receiving body and said plunger-driving motor and communicates between said intake section and said return section to guide at least a portion of the fuel from said intake section toward said return section; and wherein said return section is located at a position higher than said intake section such that fuel vapor present in the fuel at said intake section floats upward through said circulation passage to carry the fuel to said return section.

2. The fuel injection device according to claim 1, wherein said plunger-driving motor is disposed about said plunger-receiving body.

3. The fuel injection device according to claim 1, wherein said plunger-driving motor has an annular shape;

said plunger-receiving body is disposed at a center portion of said annular shape of said plunger-driving motor; and said circulation passage is disposed radially between said plunger-driving motor and said plunger-receiving body.

4. The fuel injection device according to claim 3, wherein said circulation passage extends in an axial direction of said annular shape of said plunger-driving motor.

5. The fuel injection device according to claim 4, wherein said circulation passage has an annular shape and is concentric with said annular shape of said plunger-driving motor.

6. The fuel injection device according to claim 1, wherein said plunger-receiving body comprises a plunger-receiving cylinder;

said plunger-driving motor has an annular shape;

said plunger-receiving cylinder is disposed at a center portion of said annular shape of said plunger-driving motor; and said circulation passage is disposed radially between said plunger-driving motor and said plunger-receiving body.

7. The fuel injection device according to claim 6, wherein said circulation passage has an annular shape and is concentric with said annular shape of said plunger-driving motor.

8. The fuel injection device according to claim 1, wherein said plunger-driving motor comprises a solenoid coil disposed about said plunger-receiving body.

9. The fuel injection device according to claim 8, wherein said plunger-receiving body comprises a plunger-receiving cylinder disposed concentrically within said solenoid coil.

10. The fuel injection device according to claim 1, wherein said plunger has an exhaust passage formed longitudinally through a center portion thereof and arranged to guide fuel to said return section.

11. The fuel injection device according to claim 10, wherein a preliminary pressure valve is arranged in said exhaust passage of said plunger to impart a preliminary pressure to the fuel at an initial stage of a pressurizing stroke of said plunger.

12. The fuel injection device according to claim 11, wherein a spill valve is provided in said pressure chamber and is arranged to be contacted by said plunger upon completion of said initial stage of said pressurizing stroke so as to block said exhaust passage.

13. The fuel injection device according to claim 12, further comprising a check valve arranged to allow fuel to flow into said pressure chamber from the fuel tank via said intake section only during an intake stroke of said plunger.

14. The fuel injection device according to claim 13, wherein a branch passage is provided to bypass said check valve to guide fuel from the fuel tank to said circulation passage.

15. The fuel injection device according to claim 14, wherein said branch passage and said check valve are provided in said intake section.

16. The fuel injection device according to claim 11, further comprising a check valve arranged to allow fuel to flow into said pressure chamber from the fuel tank via said intake section only during an intake stroke of said plunger.

17. The fuel injection device according to claim 16, wherein a branch passage is provided to bypass said check valve to guide fuel from the fuel tank to said circulation passage.

18. The fuel injection device according to claim 17, wherein said branch passage and said check valve are provided in said intake section.

19. The fuel injection device according to claim 1, further comprising a check valve arranged to allow fuel to flow into said pressure chamber from the fuel tank via said intake section only during an intake stroke of said plunger.

20. The fuel injection device according to claim 19, wherein a branch passage is provided to bypass said check valve to guide fuel from the fuel tank to said circulation passage.

21. The fuel injection device according to claim 20, wherein said branch passage and said check valve are provided in said intake section.

22. The fuel injection device according to claim 1, wherein said return section comprises a fuel return pipe fluidically connected to said circulation passage for returning fuel circulated therethrough to the fuel tank.

23. An internal combustion engine arrangement comprising a fuel intake part and a fuel injection device adapted to inject fuel from a fuel tank into said fuel intake part, said fuel injection device comprising:

a body;

an intake section provided at a lower section of said body and arranged for intake of the fuel from the fuel tank;

a return section provided at an upper section of said body and arranged to return surplus fuel to the fuel tank;

an injection nozzle mounted to said body and arranged to inject the fuel into said fuel intake part; and a plunger pump mounted in said body and comprising a plunger-receiving body having a passage extending therethrough, a plunger disposed in said passage of said plunger-receiving body, and a pressure chamber at least partly formed in said passage of said plunger-receiving body at an end of said plunger and communicated with said intake section, said plunger being movably disposed in said passage for reciprocal movement therein in a first direction to perform an intake stroke to draw the fuel into said pressure chamber and in a second direction to perform a pressurizing stroke to pressurize the fuel in said pressure chamber;

wherein said plunger pump further includes a plunger-driving motor operably coupled to said plunger to drive said plunger in at least one of said first and second directions;

wherein a circulation passage is provided between said plunger-receiving body and said plunger-driving motor and communicates between said intake section and said return section to guide at least a portion of the fuel from said intake section toward said return section; and wherein said return section is located at a position higher than said intake section such that fuel vapor present in the fuel at said intake section floats upward through said circulation passage to carry the fuel to said return section.

24. A fuel injection device adapted to inject fuel from a fuel tank into a fuel intake part of an internal combustion engine, said fuel injection device comprising:

a body;

an intake section provided at a lower section of said body and arranged for intake of the fuel from the fuel tank;

a return section provided at an upper section of said body and arranged to return surplus fuel to the fuel tank;

an injection nozzle mounted to said body and arranged to inject the fuel into the fuel intake part of the internal combustion engine; and a plunger pump mounted in said body and comprising a plunger-receiving body having a passage extending therethrough, a plunger disposed in said passage of said plunger-receiving body, and a pressure chamber at least partly formed in said passage of said plunger-receiving body at an end of said plunger and communicated with said intake section;

wherein said plunger is movably disposed in said passage of said plunger-receiving body for reciprocal movement therein in first and second directions, so that said movement of said plunger in said first direction constitutes an intake stroke that reduces pressure in said pressure chamber so as to draw fuel thereinto from the fuel tank via said intake section and movement of said plunger in said second direction constitutes a pressurizing stroke to pressurize the fuel in said pressure chamber;

wherein said plunger pump further includes a plunger-driving motor operably coupled to said plunger to drive said plunger in at least one of said first and second directions;

wherein a circulation passage is provided to communicate between said intake section and said return section; and wherein said return section is located at a position higher than said intake section such that fuel vapor present in the fuel at said intake section floats upward through said circulation passage to carry the fuel to said return section.

25. The fuel injection device according to claim 24, wherein said circulation passage is provided between said plunger-receiving body and said plunger-driving motor and communicates between said intake section and said return section to guide at least a portion of the fuel from said intake section toward said return section.

26. The fuel injection device according to claim 25, wherein said plunger-driving motor is disposed about said plunger-receiving body.

27. The fuel injection device according to claim 25, wherein said plunger-driving motor has an annular shape;

said plunger-receiving body is disposed at a center portion of said annular shape of said plunger-driving motor; and said circulation passage is disposed radially between said plunger-driving motor and said plunger-receiving body.

28. The fuel injection device according to claim 25, wherein said plunger-receiving body comprises a plunger-receiving cylinder;

said plunger-driving motor has an annular shape;

said plunger-receiving cylinder is disposed at a center portion of said annular shape of said plunger-driving motor; and said circulation passage is disposed radially between said plunger-driving motor and said plunger-receiving body.

29. The fuel injection device according to claim 25, wherein said plunger-driving motor comprises a solenoid coil disposed about said plunger-receiving body.

30. The fuel injection device according to claim 29, wherein said plunger-receiving body comprises a plunger-receiving cylinder disposed concentrically within said solenoid coil.

31. The fuel injection device according to claim 24, wherein said plunger pump has an exhaust passage extending longitudinally through said plunger for guiding fuel from said pressure chamber toward said return section, and a preliminary pressure valve arranged at said exhaust passage;

said preliminary pressure valve is arranged to block flow of fuel through said exhaust passage of said plunger during movement of said plunger in said first direction; and said preliminary pressure valve is arranged to impart a preliminary pressure to the fuel at an initial stage of a pressurizing stroke of said plunger.

32. The fuel injection device according to claim 31, wherein a spill valve is provided in said pressure chamber and is arranged to be contacted by said plunger upon completion of said initial stage of said pressurizing stroke so as to block said exhaust passage.

33. The fuel injection device according to claim 25, further comprising a check valve arranged to allow fuel to flow into said pressure chamber from the fuel tank via said intake section only during an intake stroke of said plunger.

34. The fuel injection device according to claim 33, wherein a branch passage is provided to bypass said check valve to guide fuel from the fuel tank to said circulation passage.

35. The fuel injection device according to claim 24, further comprising a check valve arranged to allow fuel to flow into said pressure chamber from the fuel tank via said intake section only during an intake stroke of said plunger.

36. An internal combustion engine arrangement comprising a fuel intake part and a fuel injection device adapted to inject fuel from a fuel tank into said fuel intake part, said fuel injection device comprising:

a body;

an intake section provided at a lower section of said body and arranged for intake of the fuel from the fuel tank;

a return section provided at an upper section of said body and arranged to return surplus fuel to the fuel tank;

an injection nozzle mounted to said body and arranged to inject the fuel into said fuel intake part; and a plunger pump mounted in said body and comprising a plunger-receiving body having a passage extending therethrough, a plunger disposed in said passage of said plunger-receiving body, and a pressure chamber at least partly formed in said passage of said plunger-receiving body at an end of said plunger and communicated with said intake section;

wherein said plunger is movably disposed in said passage of said plunger-receiving body for reciprocal movement therein in first and second directions so that said movement of said plunger in said first direction constitutes an intake stroke that reduces pressure in said pressure chamber so as to draw fuel thereinto from the fuel tank via said intake section and so that said movement of said plunger in said second direction constitutes a pressurizing stroke to pressurize the fuel in said pressure chamber;

wherein said plunger pump further includes a plunger-driving motor operably coupled to said plunger to drive said plunger in at least one of said first and second directions;

wherein a circulation passage is provided to communicate between said intake section and said return section; and wherein said return section is located at a position higher than said intake section such that fuel vapor present in the fuel at said intake section floats upward through said circulation passage to carry the fuel to said return section.

37. The internal combustion engine arrangement according to claim 36, wherein said circulation passage is provided between said plunger-receiving body and said plunger-driving motor and communicates between said intake section and said return section to guide at least a portion of the fuel from said intake section toward said return section.

38. The internal combustion engine arrangement according to claim 36, wherein said plunger pump has an exhaust passage extending longitudinally through said plunger for guiding fuel from said pressure chamber toward said return section, and a preliminary pressure valve arranged at said exhaust passage; and said preliminary pressure valve is arranged to block flow of fuel through said exhaust passage of said plunger during movement of said plunger in said first direction.

* * * * *